US011607584B2

(12) United States Patent
Fowler et al.

(10) Patent No.: US 11,607,584 B2
(45) Date of Patent: Mar. 21, 2023

(54) EXERCISE ROLLER

(71) Applicant: Rippin Fitness, Berea, OH (US)

(72) Inventors: Thomas Fowler, Berea, OH (US); Andrew Lawrence Somrack, Newbury, OH (US)

(73) Assignee: Rippin Fitness, Berea, OH (US)

( * ) Notice: Subject to any disclaimer, the term of this patent is extended or adjusted under 35 U.S.C. 154(b) by 0 days.

(21) Appl. No.: 17/721,512

(22) Filed: Apr. 15, 2022

(65) Prior Publication Data

US 2022/0233912 A1 Jul. 28, 2022

Related U.S. Application Data

(63) Continuation of application No. 17/648,485, filed on Jan. 20, 2022.

(60) Provisional application No. 63/139,467, filed on Jan. 20, 2021.

(51) Int. Cl.

| | |
|---|---|
| ***A63B 23/02*** | (2006.01) |
| ***A63B 21/00*** | (2006.01) |
| ***A63B 22/20*** | (2006.01) |

(52) U.S. Cl.

CPC ..... *A63B 23/0211* (2013.01); *A63B 21/0004* (2013.01); *A63B 21/4019* (2015.10); *A63B 21/4035* (2015.10); *A63B 22/20* (2013.01)

(58) Field of Classification Search

CPC ..... A63B 21/0004; A63B 21/4019; A63B 21/4035; A63B 22/20; A63B 23/0211; A61H 15/0092

See application file for complete search history.

(56) References Cited

U.S. PATENT DOCUMENTS

| | | | | |
|---|---|---|---|---|
| 1,882,490 | A * | 10/1932 | Falck | A61H 15/0092 601/120 |
| 3,752,475 | A | 8/1973 | Ott | |
| 4,595,197 | A | 7/1986 | Hagstrom et al. | |
| 5,004,229 | A | 4/1991 | Lind | |
| 6,398,694 | B1 * | 6/2002 | Bountourakis | A63B 21/00069 601/134 |
| 7,972,251 | B2 | 7/2011 | Peddar | |
| 8,702,574 | B2 | 4/2014 | Abranchess | |
| 8,894,555 | B2 * | 11/2014 | Colledge | A63B 23/14 482/118 |
| 9,011,303 | B2 | 4/2015 | MacColl et al. | |
| 9,415,258 | B1 * | 8/2016 | Higgins | A63B 21/068 |

(Continued)

FOREIGN PATENT DOCUMENTS

KR 101866136 B1 6/2018

OTHER PUBLICATIONS

Two Wheels Push-ups Device / ab slider exercises (indoor fitness equipment ); available at https://www.alibaba.com/product-detail/Two-wheels-Push-ups-Device-ab_787795791.html; obtained Jan. 19, 2022.

(Continued)

*Primary Examiner* — Joshua Lee

(74) *Attorney, Agent, or Firm* — Renner, Otto, Boisselle & Sklar, LLP

(57) ABSTRACT

An exercise roller includes an elongated bar having grip handles arranged at opposing axial ends of the elongated bar, a cylindrical core supported by the elongated bar between the grip handles, and a cover that surrounds the cylindrical core and is formed of a material having a repeating pattern.

19 Claims, 5 Drawing Sheets

(56) References Cited

U.S. PATENT DOCUMENTS

| | | | | |
|---|---|---|---|---|
| 9,572,745 | B2 * | 2/2017 | Lin | A61H 15/0092 |
| 2007/0298947 | A1 | 12/2007 | Eksteen | |
| 2016/0030797 | A1 | 2/2016 | Erickson | |
| 2016/0279009 | A1 * | 9/2016 | Somjee | A61H 15/00 |
| 2016/0310352 | A1 * | 10/2016 | Chen | A61H 15/0092 |
| 2017/0087398 | A1 | 3/2017 | Chang | |

OTHER PUBLICATIONS

Sklz Core Wheels; available at https://www.purehockey.com/product/sklz-core-wheels/itm/14407-2/?gclid=CjwKCAjw-4_mBRBuEiwA5xnFIL69CsRFBXkZ5SeNCGLKWNC0u0UC1csEE6O6CAfexK755EpWZEZt8BoCQ80QAvD_BwE&utm_medium=referral&utm_source=hockeygiant.com; obtained Jan. 19, 2022.

* cited by examiner

EXERCISE ROLLER

RELATED APPLICATIONS

This application is a continuation of U.S. application Ser. No. 17/648,485 filed Jan. 20, 2022, which claims the benefit of U.S. Application No. 63/139,467 filed Jan. 20, 2021, both of which are hereby incorporated by reference in their entities.

TECHNICAL FIELD

The present disclosure relates to exercise equipment and more particularly to an exercise roller.

BACKGROUND

Exercise rollers may be used to exercise a variety of muscles. For example, abdominal rollers may be used to exercise abdominal muscles. Such an abdominal roller typically includes handles that are gripped by the user and a wheeled portion between the handles that can roll along a surface. However, conventional abdominal rollers are deficient in that the devices may be limited in functionality or may be uncomfortable and difficult to use for some users. Still another deficiency of conventional abdominal rollers is that the rollers may be complex to manufacture.

SUMMARY

The present application provides an exercise roller that includes a bar with grip handles for the hands of a user, a cylindrical core supported by the bar, and a cover that surrounds the core and is formed of a material having a repeating pattern. For example, the pattern may include a plurality of coils that are formed of a unitary cord that is continuous along an entire length of the cylindrical core. In other embodiments, other repeating or symmetrical patterns of the material may also be suitable. The material of the cover may be, for example, foam. In another embodiment, however the material of the cylindrical core and cover may be steel. The cylindrical core may have a length that is greater than half of a length of the bar. The core may extend an entire length between the grip handles such that the grip handles are directly adjacent the core.

The exercise roller may be used for a variety of exercises, including but not limited to abdominal exercises. Advantageously, in the embodiment in which the material of the cover is foam, the exercise roller is configured to provide improved comfort and support during rolling of the cylindrical core along a surface due to the material of the foam cover, and the density of the inner core and the foam. For example, the using the foam cover may be particularly advantageous in preventing shin splints as compared with conventional exercise or abdominal rollers. In exemplary applications, the roller may be used to provide a deep tissue or soft tissue massage.

In exemplary embodiments, brackets may be removably attached to the bar to enable straps, carabiners for exercise bands, or other attachments to be integrated into the exercise roller such that the exercise roller may be modular. Thus, the functionality of the exercise roller is increased as compared with conventional abdominal rollers. The bar is also formed of a metal material that is configured to support the full body weight of a person such that a user could stand on the grip handles and the foam cover supported by the core and the bar.

The cover of the exercise roller may be formed of closed-cell foam material, or any other suitable material which is wrapped, overmolded, stretched, adhered, or friction fit around the core. The grip handles may also be wrapped, overmolded, stretched, adhered, or friction fit onto the bar. Advantageously, the exercise roller may be less complex to manufacture as compared with conventional exercise rollers.

According to an aspect of the disclosure, an exercise roller may include a cover having a repeating pattern. The cover may be foam.

According to an aspect of the disclosure, an exercise roller may include removable brackets that enable additional components to be integrated to the roller.

According to an aspect of the disclosure, an exercise roller may include a cylindrical core having a length that is greater than half of the length of a bar on which the core is supported such that the core is directly adjacent grip handles.

According to an aspect of the disclosure, a method for manufacturing an exercise roller may include overmolding a cover to a cylindrical core.

According to an aspect of the disclosure, an exercise roller includes an elongated bar extending in an axial direction and having grip handles arranged at opposing axial ends of the elongated bar, a cylindrical core supported by the elongated bar between the grip handles, and a cover that surrounds the cylindrical core and is formed of a material having a repeating pattern.

According to an embodiment in accordance with any paragraph(s) of this summary, the repeating pattern may include a plurality of coils.

According to another embodiment in accordance with any paragraph(s) of this summary, the repeating pattern includes protrusions separated by indents.

According to another embodiment in accordance with any paragraph(s) of this summary, the protrusions include at least one of ridges, pyramids, pillars, cones, rounded protrusions, and squared protrusions.

According to another embodiment in accordance with any paragraph(s) of this summary, the repeating pattern includes coiled portions arranged in a set and separated from an adjacent set of coiled portions by a smooth portion.

According to an embodiment in accordance with any paragraph(s) of this summary, the cover may extend over an entire length of the cylindrical core and the plurality of coils are formed along the entire length.

According to an embodiment in accordance with any paragraph(s) of this summary, the plurality of coils may be formed of a unitary cord that is continuous along the entire length.

According to an embodiment in accordance with any paragraph(s) of this summary, the plurality of coils may be directly adjacent each other and each of the plurality coils may have a same thickness.

According to an embodiment in accordance with any paragraph(s) of this summary, a length of the cylindrical core may be greater than half of a length of the elongated bar.

According to an embodiment in accordance with any paragraph(s) of this summary, the length of the cylindrical core may be greater than a length of each of the grip handles.

According to an embodiment in accordance with any paragraph(s) of this summary, the cylindrical core may extend an entire length between the grip handles whereby the grip handles are directly adjacent the cylindrical core.

According to an embodiment in accordance with any paragraph(s) of this summary, the exercise roller may include at least one bearing axially interposed between the cylindrical core and the grip handles.

According to an embodiment in accordance with any paragraph(s) of this summary, the exercise roller may include at least one retainer arranged on the elongated bar.

According to an embodiment in accordance with any paragraph(s) of this summary, the cylindrical core may include an outer cylindrical wall and one or more endcaps.

According to an embodiment in accordance with any paragraph(s) of this summary, the one or more endcaps may have a plurality of spokes.

According to an embodiment in accordance with any paragraph(s) of this summary, the one or more endcaps may be solid.

According to an embodiment in accordance with any paragraph(s) of this summary, the cylindrical core may be formed of a plastic material.

According to an embodiment in accordance with any paragraph(s) of this summary, the cylindrical core may be formed of a metal material, such as aluminum or steel.

According to an embodiment in accordance with any paragraph(s) of this summary, the exercise roller may include a plurality of brackets that are mounted to the elongated bar.

According to an embodiment in accordance with any paragraph(s) of this summary, each of the plurality of brackets may be rectangular or circular.

According to an embodiment in accordance with any paragraph(s) of this summary, each of the plurality of brackets may define at least one aperture configured to receive a connector.

According to an embodiment in accordance with any paragraph(s) of this summary, each of the plurality of brackets may be circular and the at least one aperture includes a plurality of apertures spaced along a circumference of a corresponding one of the plurality of brackets.

According to an embodiment in accordance with any paragraph(s) of this summary, the exercise roller may include a strap connected between two of the plurality of brackets that are disposed at ends of the grip handles.

According to an embodiment in accordance with any paragraph(s) of this summary, the bracket may protrude radially outwardly from the elongated bar to a radial distance that is less than an outermost diameter of the cylindrical core.

According to an embodiment in accordance with any paragraph(s) of this summary, the cover may be overmolded to the cylindrical core.

According to an embodiment in accordance with any paragraph(s) of this summary, the exercise roller may include one or more accessory bolts protruding axially outward from the elongated bar.

According to an embodiment in accordance with any paragraph(s) of this summary, the one or more accessory bolts may be eye bolts.

According to another aspect of the disclosure, a method of manufacturing an exercise roller includes forming grip handles at opposing ends of an elongated bar, arranging a cylindrical core on the elongated bar between the grip handles, and overmolding or wrapping a cover around the cylindrical core, wherein the cover has a pattern that repeats around the cylindrical core. The cylindrical core may be plastic or metal. The cover may be foam.

Other systems, devices, methods, features, and advantages of the present invention will be or become apparent to one having ordinary skill in the art upon examination of the following drawings and detailed description. It is intended that all such additional systems, methods, features, and advantages be included within this description, be within the scope of the present invention, and be protected by the accompanying claims.

DETAILED DESCRIPTION

Aspects of the present application pertain to exercise rollers and massagers. The exercise roller may be used for a large variety of exercises, such as core exercises (e.g., plank, roll out, knee tuck, mountain climbers, pikes, etc.), upper body exercises (e.g., push ups, chest press, pull ups, flies, bicep curls, hammer curl, tricep extensions, tricep kick-backs, tricep push downs, shoulder press, etc.), back exercises (e.g., bent over row, pull overs, etc.), lower body exercises (e.g., squats, deadlifts, lunges, etc.), and a variety of massage exercises. It is understood that the above-described exercises are provided as non-limiting examples, and that the exercise roller described herein may be used with a variety of other exercises as well. The roller may be modular to enable the multi-functionality of the roller. The roller may also be integrated into a larger workout device or machine that is configured to perform many different types of exercises.

Figure 1:
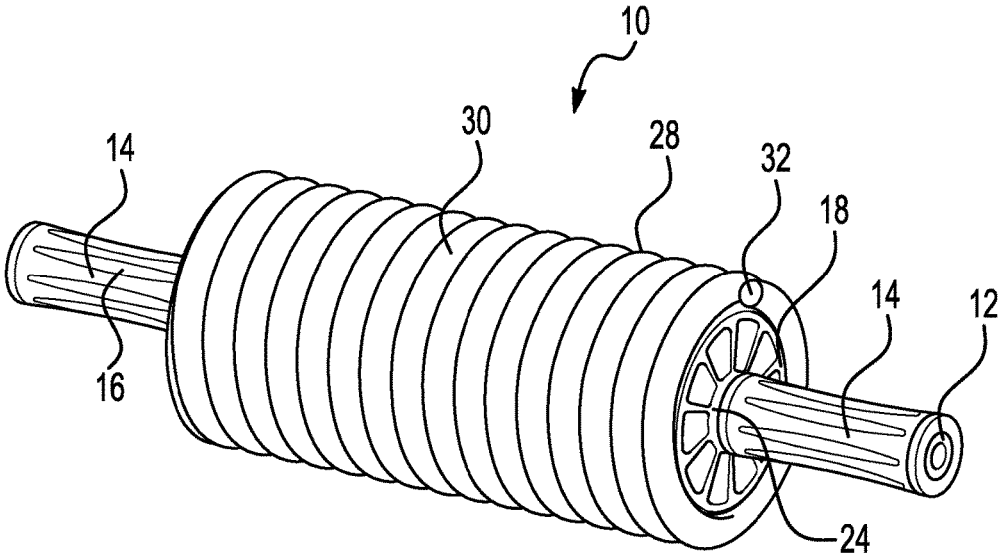
FIG. 1 is a perspective view of an exercise roller.

FIG. 1 depicts an exercise roller 10 including an elongated bar 12 having grip handles 14 arranged at opposing ends of the elongated bar 12 and a cylindrical core 18 that is supported by the elongated bar 12 between the grip handles 14. The exercise roller 10 may be formed without grip handles 14 (see embodiment of FIG. 9, described later herein). The exercise roller 10 includes a cover 28 surrounding the cylindrical core 18 for providing a surface-engaging perimeter of the exercise roller 10. Any number of bearings and retainers 24 may be used to axially locate the cylindrical core 18 on the elongated bar 12 relative to the grip handles 14 and facilitate assembly of the components. For example, the bearings may include at least one of a sleeve bearing, a roller bearing, a ball bearing, and a sintered bearing. The retainers 24 may include at least one of a retaining ring, a retaining pin, a retaining screw, and a retaining nut. It will be understood that the above-described examples of the bearings and the retainers 24 are provided as non-limiting examples, and that other types of bearings and retainers 24 may be suitable. The bearings and the retainers 24 may be axially interposed between an outer axial face of the cylindrical core 18 and an adjacent grip handle 14. Additional retainers and/or bearings may be added if other components are attached to the exercise roller 10. The bearings and retainers 24 may be formed of any suitable material, such as a metal material. For example, the bearings and retainers 24 may be made of steel, however it is understood that other metal materials may be suitable.

Figure 2:
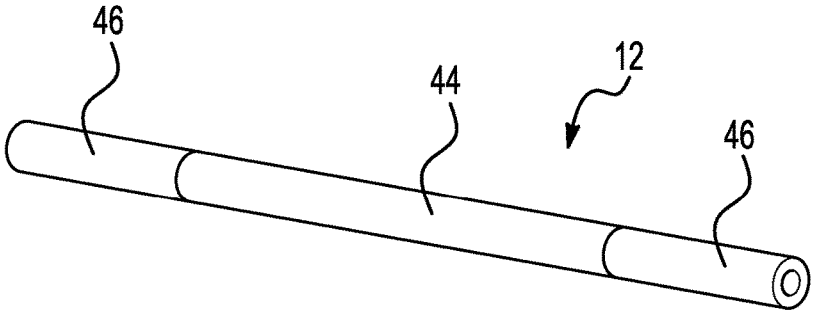
FIG. 2 is a perspective view of an elongated bar for the exercise roller of FIG. 1.

FIG. 2 depicts an embodiment of the elongated bar 12 in isolation. As depicted in the embodiment of FIG. 2, the elongated bar 12 may be hollow, however the elongated bar may alternatively be solid. The elongated bar 12 may be formed of any suitable rigid material, such as a metal. For example, the elongated bar 12 may be formed of aluminum. It is understood, however, that these materials of the elongated bar 12 are provided as non-limiting examples and that other suitable rigid materials may be applicable.

An outer diameter 42 of the elongated bar 12 may be between 0.5 inch (1.27 centimeters) and 2.0 inches (5.08 centimeters), such as approximately 1.0 inch (2.54 centimeters). The elongated bar 12 includes a middle portion 44 for supporting the cylindrical core 18 and end portions 46 for supporting the grip handles 14. The middle portion 44 and the end portions 46 of the elongated bar 12 may be continuous or the end portions 46 may be removably attachable to the middle portion 44, such as for removably attaching the grip handles 14. Additional end portions 46 may be provided such that the length of the elongated bar 12 may be increased to any desired length. The outer diameters of the end portions 46 may be the same or different than the outer diameter of the middle portion 44. It is understood that the above-described diameter of the elongated bar 12 is provided as a non-limiting example, and that other diameters may be suitable.

Figure 3:
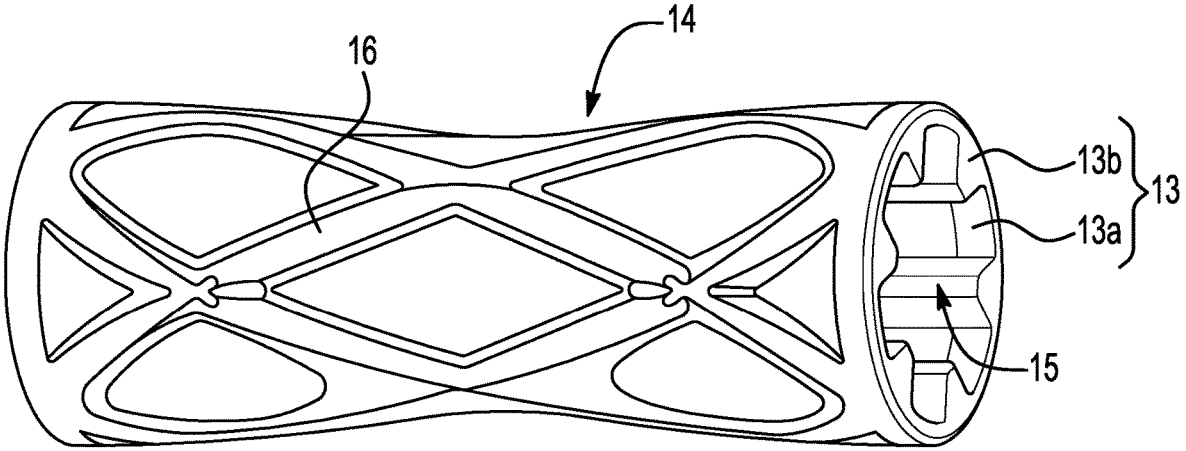
FIG. 3 is a perspective view of a grip handle for the exercise roller of FIG. 1.

FIG. 3 depicts an embodiment of a single grip handle 14 in isolation. The grip handles 14 may be formed of a soft or flexible material, such as a plastic, rubber, or foam material that is wrapped, overmolded, stretched, adhered, or friction-fit around the end portions 46 of the elongated bar 12. Each of the grip handles 14 extend along at least a portion of the end portions 46 of the elongated bar 12. Each of the grip handles 14 may extend along an entirety of the end portions 46 of the elongated bar 12, and may even extend along at least a portion of the middle portion 44 of the elongated bar 12. In exemplary embodiments, the grip handles 14 may have an outer diameter that is greater than the outer diameter of the elongated bar 12. The outer diameter of the grip handles 14 may be uniform or contoured to provide ergonomic advantages.

The grip handles 14 may include a grip pattern including, for example, a plurality of protruding elements 16, for facilitating handling of and a secure grip on the grip handles 14 by the user. Any suitable grip pattern may be formed on the grip handles 14. For example, FIG. 3 depicts a lattice or crisscross pattern of protruding elements 16, while FIG. 1 depicts a plurality of spaced protruding elements 16 that extend axially along the grip handles 14 around a circumference of the grip handles 14. It is understood that these patterns are included and depicted as non-limiting examples and that other patterns may be suitable. In any embodiment, the grip pattern may be formed such that the grip handles 14 are configured to provide a deep tissue or soft tissue massage. For example, a user could use the grip handles 14 to massage his or her feet or other body parts.

Figure 4:
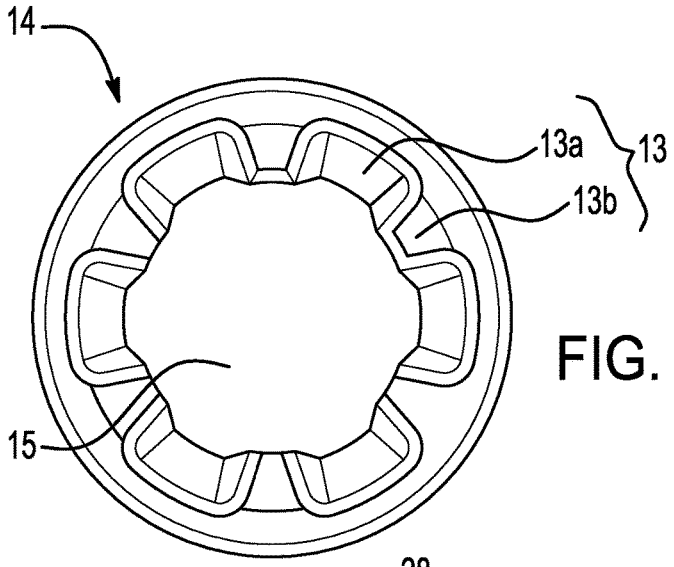
FIG. 4 is a cross-sectional view of the grip handle of FIG. 3.

The grip handles 14 may be removable relative to the elongated bar 12. For example, the grip handles 14 may include a rigid body that is formed separately from the elongated bar 12 and subsequently attached to the elongated bar 12 by the user. Accordingly, the grip handles 14 may include an axially extending central aperture 15 defined by an inner diameter 13 of the grip handles 14. The inner diameter 13 may have a smooth surface or may alternatively be textured to facilitate a tight, non-slip fit on the elongated bar 12. As depicted in FIGS. 3 and 4, for example, the inner diameter 13 of the grip handles 14 may include a plurality of radially extending recesses 13*a* and protrusions 13*b*. The plurality of radially extending recesses 13*a* and protrusions 13*b* also advantageously reduce the amount of material necessary to form the handles, while keeping a consistent wall thickness on the handles. Any other suitable interlocking or fitting elements may be used to removably attach the removable grip handles 14 and the elongated bar 12, such as clasps, bayonet connectors, male and female couplers, threaded connectors, tongue and groove, etc.

A plurality of different grip handles 14 may be provided in a modular fashion with the exercise roller 10, for example to provide a massage function as compared with an exercise function, such that a user may selectively apply the different grip handles 14 according to their desired use of the exercise roller 10. Any number of additional grip handles 14 may be added to the elongated bar 12 to increase the overall length of the exercise roller 10, such as for taller or larger individuals.

Figure 5:
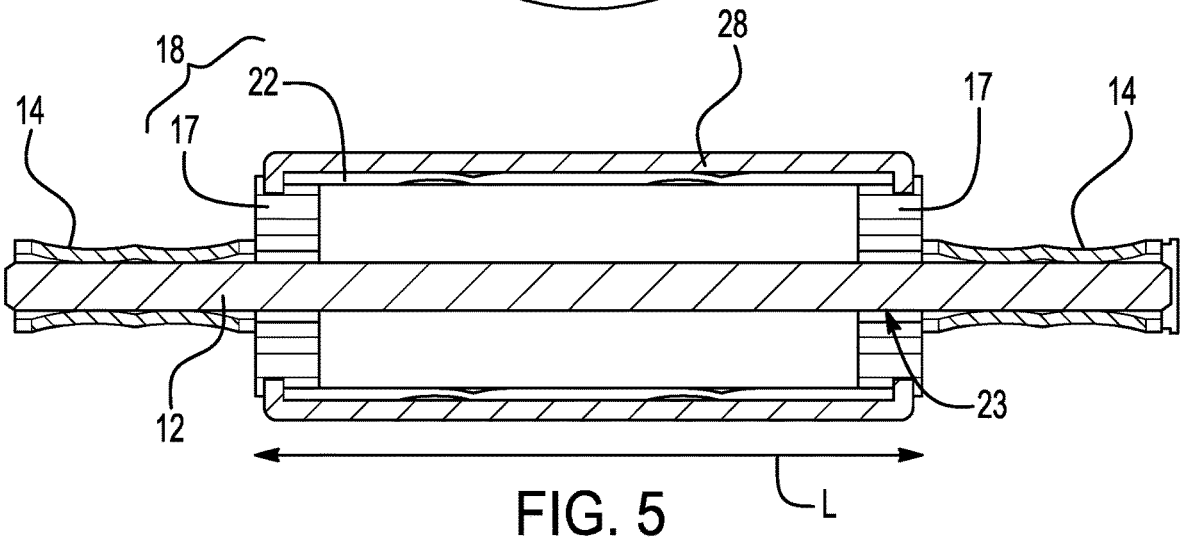
FIG. 5 is a cross-sectional view of an exercise roller.

FIG. 5 depicts a cross-section of an embodiment of the exercise roller 10 for purposes of describing the cylindrical core 18 in more detail. The elongated bar 12 and the cylindrical core 18 may be fixed for rotation such that the cylindrical core 18 is rolled along a surface, such as a ground surface or vertical wall or other non-horizontal surface, by the user moving the elongated bar 12. A length L of the cylindrical core 18 may be greater than half of a length of the elongated bar 12, such that the grip handles 14 are directly adjacent the cylindrical core 18, and the length L of the cylindrical core 18 may be greater than a length of each of the grip handles 14. Accordingly, the cylindrical core 18 may extend along an entire shoulder span of the user. The elongated bar 12 is configured to extend through a central aperture 23 along the entire length L of the cylindrical core 18. The cylindrical core 18 may be formed of any suitable material, such as an extruded rigid plastic material and may have a plurality of extruded fins for strength. For example, polyvinyl chloride may be a suitable material. It is understood that these materials are provided as non-limiting examples and that many other materials may be suitable.

An outer diameter of the cylindrical core 18 may be approximately twice as large as an outer diameter of the grip handles 14. In an exemplary embodiment, the length L may be between 6 inches (15.24 centimeters) and 18 inches (45.72 centimeters). For example, the length L may be approximately 12 inches (30.48 centimeters). A length of the elongated bar 12 may be between 18 inches (45.72 centimeters) and 30 inches (76.2 centimeters), such as approximately 24 inches (60.96 centimeters). The outer diameter of the cylindrical core 18 may be between 3 inches (7.62 centimeters) and 5 inches (12.70 centimeters). It is understood that these dimensions are provided as non-limiting examples and that many other dimensions may be suitable for sizing the exercise roller 10 up or down.

In the depicted embodiment, the cylindrical core 18 is formed of multiple portions that are separated and/or interconnected to reduce the overall amount of material and weight of the cylindrical core 18. Specifically, the depicted cylindrical core 18 includes an outer circumferential wall 22 open at opposing axial ends of the cylindrical core 18. The cylindrical core 18 may additionally include two endcaps 17, each configured to at least partially close off one of the open opposing axial ends of the cylindrical core 18. For example, an outer diameter 21 of the endcaps 17 may be configured to have an interference fit with an inner diameter of the outer circumferential wall 22 of the cylindrical core 18. In another embodiment, the outer diameter 21 of the endcaps 17 and the inner diameter of the outer circumferential wall 22 may fit together in another manner, such as by a threaded connection. It is understood that other suitable connections between the outer diameter 21 of the endcaps 17 and the inner diameter of the outer circumferential wall 22 may be applicable. The cylindrical core 18 may be formed to have a hollow storage compartment inside the outer cylindrical wall 22 and opposing endcaps 17 for storing brackets or other attachments of the exercise roller 10. In other embodiments, however, the outer cylindrical wall 22 and the endcaps 17 may be integrally formed and solid. Also, the cylindrical core 18 may be weighted to enhance certain exercises performed with the exercise roller 10. For example, additional weights may be applied to the outer cylindrical wall 22 or inserted into the hollow storage compartment inside the outer cylindrical wall 22.

Figure 6:
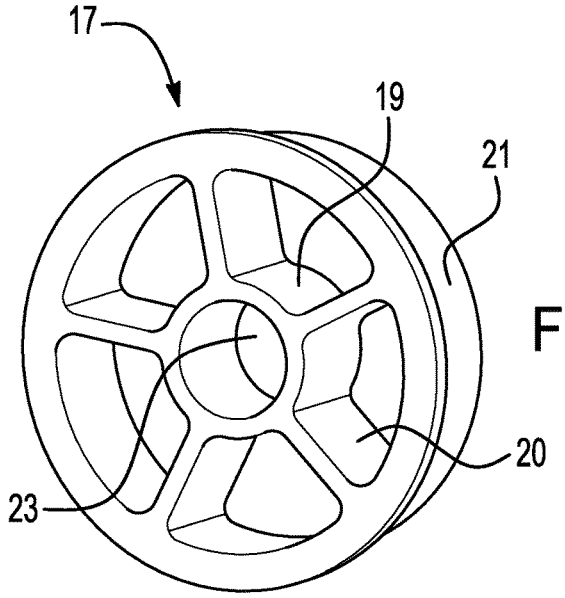
FIG. 6 is a perspective view of an endcap of a cylindrical core of the exercise roller of FIG. 5.

As depicted in FIG. 6, the endcaps 17 may include a plurality of spokes 20 that extend radially outwardly from an inner diameter 19 of the endcaps 17, which at least partially forms the central aperture 23, to an outer diameter 21 of the endcaps 17. Any number of spokes 20 may be provided, such as between four and fourteen. As shown in FIG. 6, the endcaps 17 may have five spokes 20. In other embodiments, however, the endcaps 17 may have more than five spokes 20 (see, for example, the embodiment depicted in FIG. 1). The spokes 20 may be axisymmetrically arranged. In other embodiments, the cylindrical core 18 may have a honeycomb, web, or other truss-like structure. Shapes that reduce the amount of material may be advantageous in reducing the overall weight of the structure. However, in another embodiment, the endcaps 17 may be solid.

In addition to the embodiment depicted in FIG. 1, FIGS. 7-9 depict various embodiments of the cover 28 of the exercise roller 10. As previously described, the cover 28 surrounds the cylindrical core 18 and may extend along the entire length L of the cylindrical core 18, or alternatively may extend along only a portion of the length L of the cylindrical core 18. If the cylindrical core 18 is formed of multiple portions, the cover 28 may continuously extend over all of the multiple portions such that the cylindrical core 18 only engages portions of the inner side of the cover 28. The cover 28 may be formed of foam, for example. A rigid foam material such as polyurethane or polystyrene may be suitable. A closed cell silicone foam may also be suitable. It is understood, however, that these materials are provided as non-limiting examples, and that other materials may be suitable for the cover 28. A density of the foam cover 28 may be, for example, 20 pounds per cubic foot (lbs./cu. ft.). It is understood, however, that this density is provided as a non-limiting example and that other densities may be suitable. For example, different densities could be used to apply different forces while massaging with the exercise roller.

Figure 7:
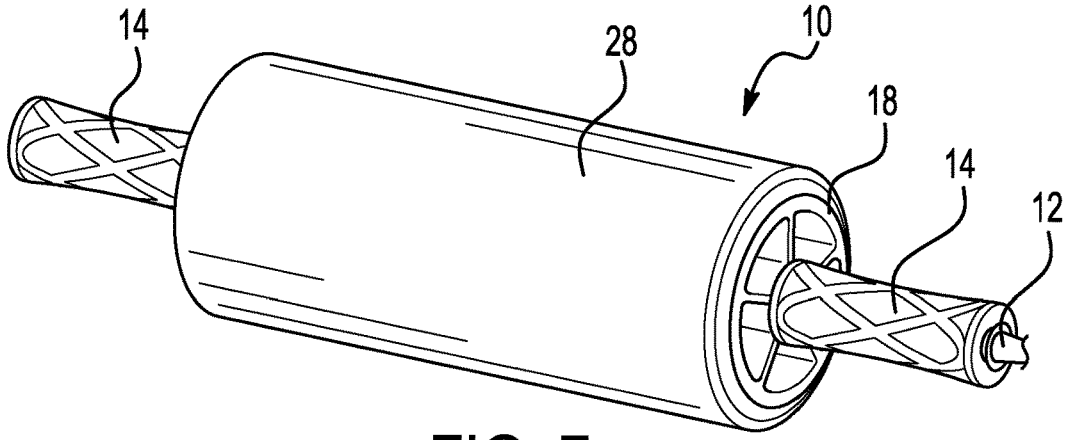
FIG. 7 is a perspective view of another exercise roller.
Figure 8:
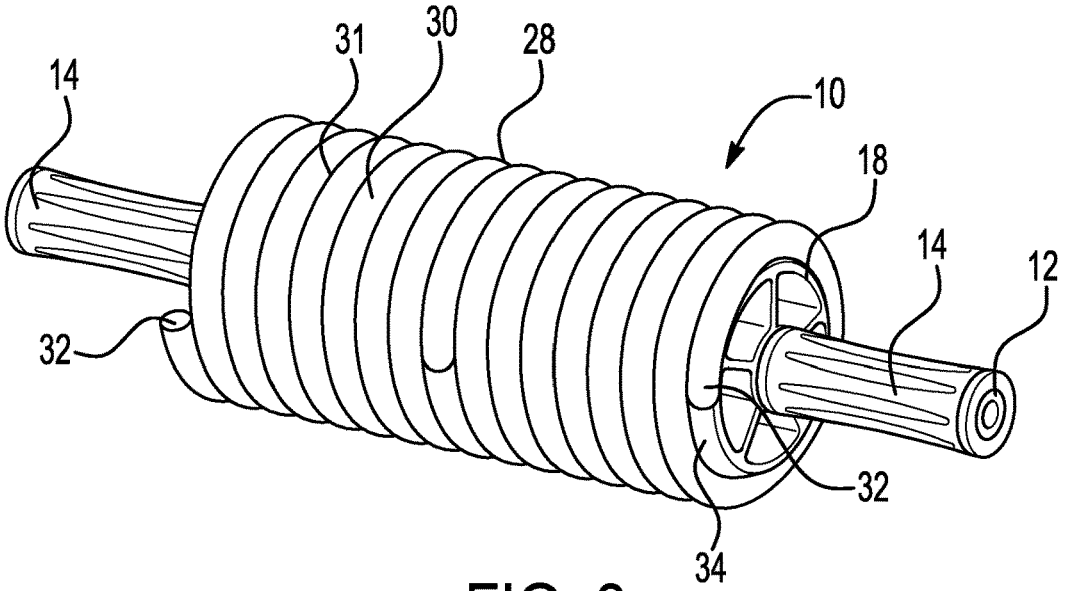
FIG. 8 is a perspective view of yet another exercise roller.
Figure 9:
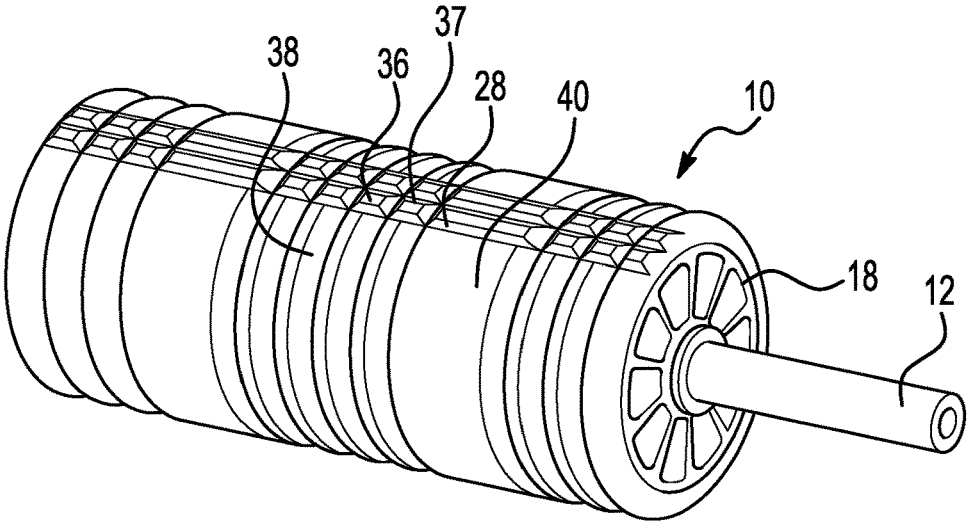
FIG. 9 is a perspective view of yet another exercise roller.

The material of the cover 28 may be smooth, as depicted in the embodiment of FIG. 7. For example, in an embodiment, the cylindrical core 18 and cover 28 may be made of solid and smooth material, such as a metal material like steel. The material of the cover 28 may alternatively have a repeating and symmetrical pattern that extends around the cylindrical core 18, as depicted in FIGS. 1, 8 and 9. The pattern may be formed to provide a muscle massage feature for the exercise roller 10. The pattern may be an ordered pattern having depressions and protrusions to provide smooth rolling of the exercise roller 10 along the surface and gripping, such that the exercise roller 10 does not slip during use. Many different configurations of the cover 28 and the pattern may be suitable.

For example, as depicted in FIGS. 1 and 8, the pattern may include a plurality of coils 30 that extend radially around the cylindrical core 18. Adjacent coils 30 have a depression 31 between the coils 30. The coils 30 may extend radially in a plane that is perpendicular to the longitudinal axis of the exercise roller 10 as defined by the elongated bar 12. The coils 30 may be defined by a single cord that is continuous along the length L, such that each of the coils 30 has a same thickness. The coils 30 may be formed along the entire length L of the cylindrical core 18, or alternatively along only a portion of the length L of the cylindrical core 18, and may directly abut against each other. The cord may be solid or hollow. As depicted in FIG. 1, ends 32 of the cord that define the coils 30 may be tucked into the adjacent coil 30 such that the end 32 is not free or loose. Alternatively, as depicted in FIG. 8, the ends 32 of the coil may be free such that a portion 34 of the cylindrical core 18 is exposed.

In another embodiment, the cover 28 has a different repeating pattern as compared with the pattern shown in FIGS. 1, 7 and 8. In this embodiment, the pattern of the cover 28 includes protrusions 36 which may be formed as ridges, pyramids, pillars, bumps, etc. that are separated by indents 37. Many other protrusion shapes may be possible for the pattern, such as cones, rounded protrusions and squared protrusions. The repeating pattern shown in FIG. 9 may also include coiled portions 38 which are arranged in a set and separated from an adjacent set of coiled portions 38 by a smooth portion 40. It is understood that the above-described and depicted patterns of the cover 28 material are provided as non-limiting examples and many other patterns other than the patterns shown in FIGS. 1 and 7-9 may be suitable.

A thickness of the cover 28 may be selected to ensure comfort during use of the exercise roller 10. For example, the thickness may be between 0.5 inch (1.27 centimeters) and 1.5 inches (3.81 centimeters). The thickness may be greater than the thickness of the outer diameter of the cylindrical core 18. In an embodiment in which the pattern includes the coils 30, the coils 30 may be formed to have different thicknesses. For example, coils 30 having the same thickness may be arranged in an alternating pattern along the longitudinal axis such that the rolling remains steady, but less material is used to form the cover 28. It is understood that these thicknesses are provided as non-limiting examples and many other thicknesses may be suitable.

The foam material of the cover 28 may be wrapped, overmolded, stretched, or adhered around the cylindrical core 18, and glued or adhered to the cylindrical core 18 using any suitable method and materials. Overmolding may also be suitable for forming the cover 28 such that the foam material may be overmolded to the cylindrical core 18. If materials other than foam are used, other manufacturing methods and materials may be used to secure the cover 28 to the cylindrical core 18. The materials used for the exercise roller 10 may be lightweight and rigid materials that are selected to facilitate transportation and use of the device while still providing support. The materials may also be selected to facilitate manufacturing. The arrangement of the elongated bar 12, the cylindrical core 18, and the cover 28, and the use of the foam material for the cover 28 may be particularly advantageous in reducing shin splints as compared with conventional rollers.

Figure 10:
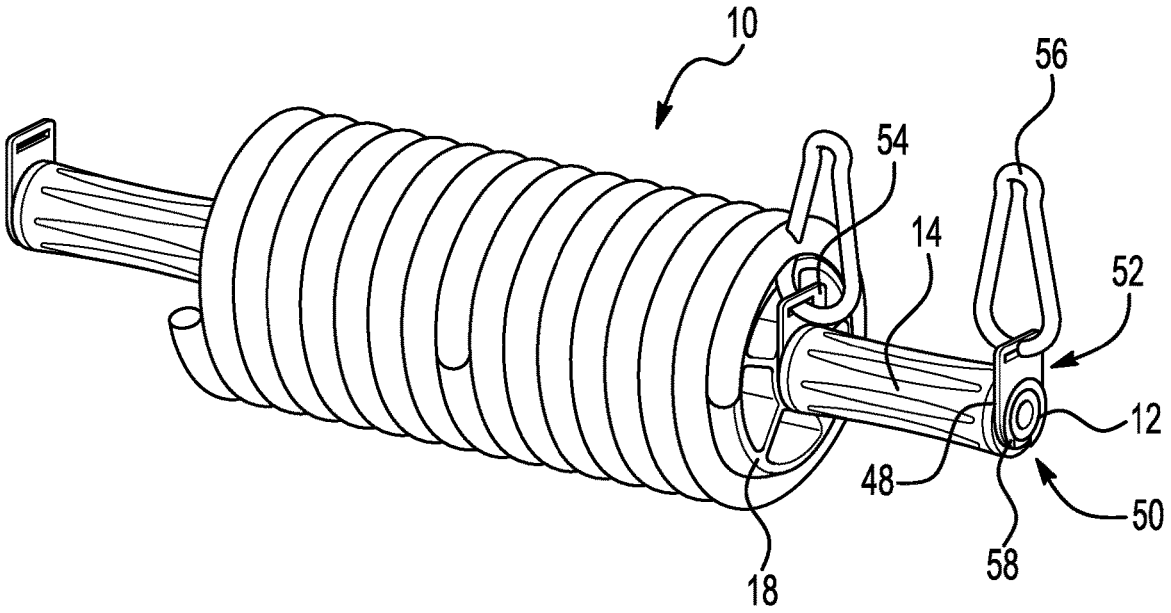
FIG. 10 is a perspective view of yet another exercise roller.
Figure 11:
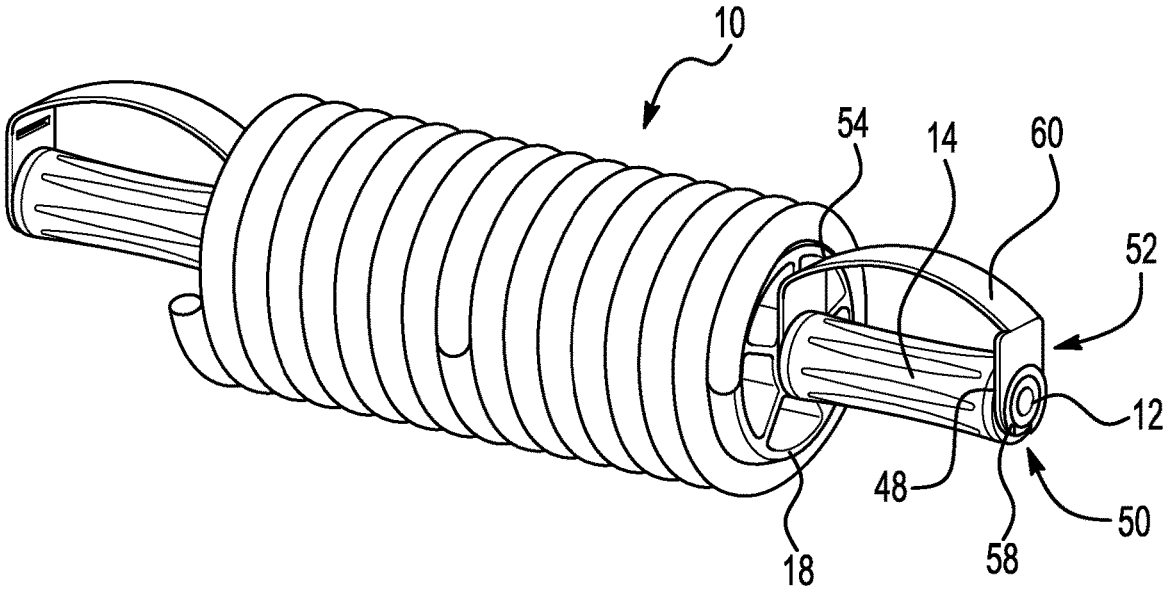
FIG. 11 is a perspective view of yet another exercise roller.
Figure 12:
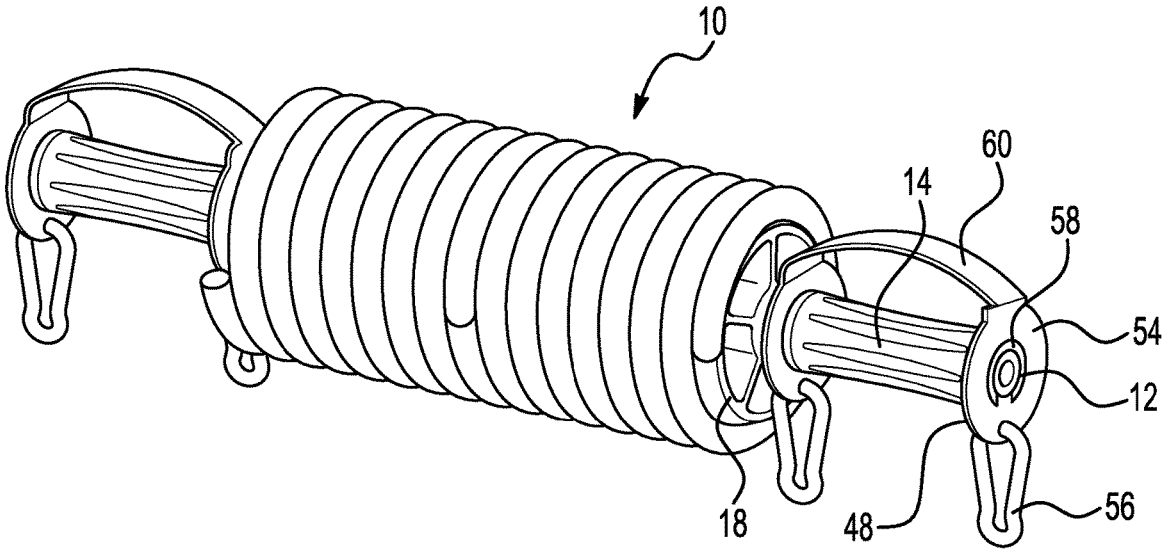
FIG. 12 is a perspective view of yet another exercise roller.

With reference to FIGS. 10-12, the exercise roller 10 may include a plurality of brackets 48 removably attached to the elongated bar 12. The brackets 48 may be fixed to the elongated bar 12. In other exemplary embodiments, the brackets 48 may be formed to rotate about the elongated bar 12 as required for specific exercises. The brackets 48 enable additional components to be integrated into the exercise roller 10 for increased functionality such that the exercise roller 10 may be modular, i.e. any suitable components and number of components may be used in conjunction with the exercise roller 10. Other components may include additional exercise equipment, such as equipment that is added to the exercise roller 10 or the exercise roller 10 may be attached to the additional piece of equipment. Other equipment may include loops, rubber bands, bands that are able to attach to a door or floor, etc. The equipment may be manually operable or automated.

Each of the brackets 48 may have any suitable shape, such as a tabular shape. The shape may be rectangular, circular, or any other shape. The axial thickness of each bracket 48 may be relatively thin such that the brackets 48 are able to be secured to the elongated bar 12 without interfering with other components of the exercise roller 10. The brackets 48 may be formed of a strong and rigid material, such as a metal material that is able to withstand the component which is to be integrated with the exercise roller 10. Aluminum and/or steel may be suitable materials. It is understood, however, that these are provided as non-limiting examples and that other metal materials may be suitable.

Each bracket 48 may have an end 50 that receives the elongated bar 12 and an opposite end 52 that protrudes radially outwardly from the elongated bar 12. The bracket 48 may protrude radially outwardly from the elongated bar 12 to a radial distance that is less than the outermost diameter of the cylindrical core 18. The opposite end 52 may define at least one aperture 54 that receives a connector. The aperture 54 may have any suitable shape and may be shaped to receive different and/or multiple connectors for connecting the exercise roller 10 to other equipment. For example, as shown in FIG. 10, a carabiner 56 may be received in the aperture 54 for attaching exercise bands or any other equipment to the exercise roller 10. Other connectors may also be suitable. For example, handles, clasps, rings, bands, tubing, etc. may be suitable.

Any number of brackets 48 may be provided and the brackets 48 may be arranged at any axial location along the elongated bar 12. For example, brackets 48 may be arranged on opposite sides of the grip handle 14 such that one of the brackets 48 is axially interposed between the grip handle 14 and the cylindrical core 18. In other exemplary embodiments, the grip handles 14 may be placed at any axial location relative to the cylindrical core 18 such that the axial position may be adjusted for a particular user or for a particular exercise. The brackets 48 may be secured and axially located by retainers 58.

As shown in FIG. 11, the connector may be a strap 60 that extends between two brackets 48 such that the strap 60 extends from the cylindrical core 18 to an axial end of the exercise roller 10. The strap 60 may be formed of a flexible or rigid material depending on the desired exercise, including hook and loop fasteners, cinches, etc. The strap 60 may be advantageous in holding a user's hands or feet to the grip handles 14 during a workout. The elongated bar 12 is configured to support the weight of a user such that the user could stand on the grip handles 14 with his or her feet supported by the strap 60. The user may also stand on the foam cover 28. The strap 60 may be formed to have an adjustable length or different brackets may be provided to change the opening provided between the strap 60 and the elongated bar 12. For example, different brackets and/or straps may be substituted out for different users.

FIG. 12 shows an embodiment in which the bracket 48 is circular. Many other different configurations and shapes of the bracket may be suitable. The circular bracket 48 includes a plurality of apertures 54 that are disposed along the circumference of the bracket 48. The apertures 54 may be evenly spaced and the apertures 54 may be formed to have the same shape or different shapes to support different components. As shown in FIG. 11, the circular bracket 48 is advantageous in that a plurality of different connectors may be integrated into the exercise roller 10, such as both the carabiner 56 and the strap 60. Any number of apertures 54 and components may be integrated into the exercise roller 10.

Figure 13:
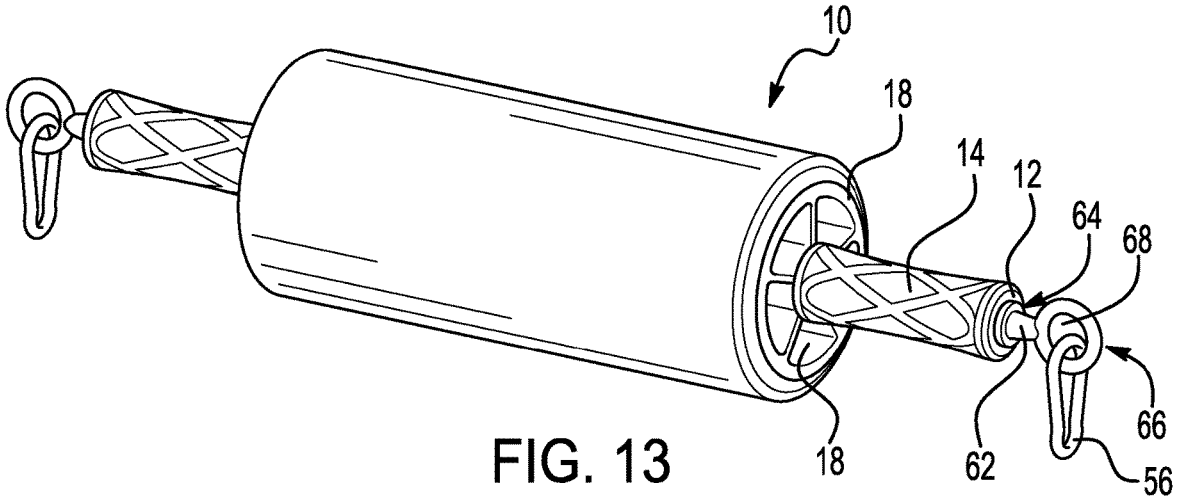
FIG. 13 is a perspective view of yet another exercise roller.

FIG. 13 depicts another embodiment of the exercise roller 10 having one or more accessory bolt 62 removably connected to the elongated bar 12 instead of one or more brackets 48. Although depicted with only two accessory bolts 62, the exercise roller 10 may include one or more accessory bolts 62 as well as one or more brackets 48. The one or more accessory bolts 62 include a first end 64 configured to mate with a respective axial end of the elongated bar 12 and a second end 66 that protrudes axially outward from the elongated bar 12. The first end 62 of the accessory bolt 62 may be configured to mate with the elongated bar 12 by, for example, a threaded connection, however any other suitable connection may be applicable. The second end 66 of the accessory bolt 62 may define at least one aperture 68 that receives a connector. For example, the accessory bolt 62 may be an eye bolt or have a similar shape. The aperture 68 may have any suitable shape and may be shaped to receive different and/or multiple connectors for connecting the exercise roller 10 to other equipment. For example, as shown in FIG. 13, carabiner 56 may be received in the aperture 68 for attaching exercise bands or any other equipment to the exercise roller 10. Other connectors may also be suitable. For example, straps, handles, clasps, rings, bands, tubing, etc. may be suitable.

Many other features of the exercise roller 10 are possible, such as the roller being able to be compacted into a smaller footprint to be stored and moved in a travel bag or container. The exercise roller 10 may be integrated with smart devices and technology to provide data feedback. Any suitable sensors may be implemented in the exercise roller 10, such as to track workouts, movement, heart rate, body temperature, etc. Mobile devices such as phones or tablets, computers, or watches and other wearable devices may be configured for communication with the exercise roller 10. For example, an application for a phone or tablet may be used to display data obtained by the sensors in the exercise roller 10.

Figure 14:
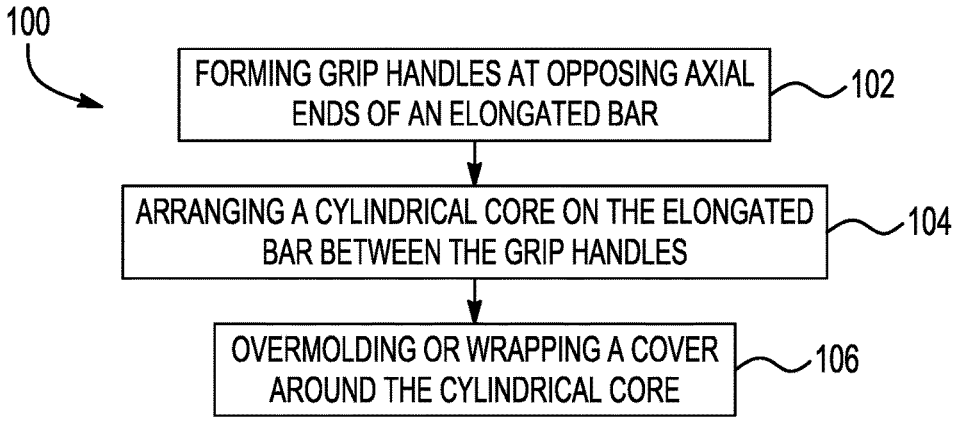
FIG. 14 is a flowchart of a method of manufacturing an exercise roller.

Any suitable fabrication methods and materials may be used to form the exercise roller 10 including the features shown in FIGS. 1-13. Exemplary methods include molding, casting, machining, machining, welding, additive manufacturing, extrusion, etc. With reference to FIG. 14, a method 100 of manufacturing the exercise roller 10 includes a step 102 of forming grip handles 14 at opposing ends of the elongated bar 12. The method 100 also includes the step 104 of arranging the cylindrical core 18 on the elongated bar 12 between the grip handles 14, and the step 106 of overmolding or wrapping the foam cover 28 around the plastic cylindrical core 18. The method may include forming the foam cover 28 to have a repeating and symmetrical pattern.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An exercise roller comprising:

an elongated bar extending in an axial direction and having grip handles arranged at opposing axial ends of the elongated bar;

a cylindrical core supported by the elongated bar between the grip handles;

a cover that surrounds the cylindrical core and is formed of a material having a repeating pattern along the cover; and a plurality of brackets that are removably mounted to the elongated bar.

2. The exercise roller according to claim 1, wherein the repeating pattern includes a plurality of coils.

3. The exercise roller according to claim 1, wherein the repeating pattern includes protrusions separated by indents.

4. The exercise roller according to claim 3, wherein the protrusions include at least one of ridges, pyramids, pillars, cones, rounded protrusions, and squared protrusions.

5. The exercise roller according to claim 3, wherein the repeating pattern includes coiled portions arranged in a set and separated from an adjacent set of coiled portions by a smooth portion.

6. The exercise roller according to claim 1, wherein a length of the cylindrical core is greater than half of a length of the elongated bar.

7. The exercise roller according to claim 1, wherein the length of the cylindrical core is greater than a length of each of the grip handles.

8. The exercise roller according to claim 1, wherein the cylindrical core extends along an entire length between the grip handles whereby the grip handles are directly adjacent the cylindrical core.

9. The exercise roller according to claim 1 further comprising at least one bearing axially interposed between the cylindrical core and the grip handles.

10. The exercise roller according to claim 1 further comprising at least one retainer arranged on the elongated bar.

11. The exercise roller according to claim 1, wherein the cylindrical core includes an outer cylindrical wall and one or more endcaps.

12. The exercise roller according to claim 1, wherein the cylindrical core is formed of a plastic material.

13. The exercise roller according to claim 1, wherein each of the plurality of brackets is rectangular or circular.

14. The exercise roller according to claim 1, wherein each of the plurality of brackets defines at least one aperture configured to receive a connector.

15. The exercise roller according to claim 14, wherein each of the plurality of brackets is circular and the at least one aperture includes a plurality of apertures spaced along a circumference of a corresponding one of the plurality of brackets.

16. The exercise roller according to claim 1 further comprising a strap connected between two of the plurality of brackets that are disposed at ends of the grip handles.

17. The exercise roller according to claim 1, wherein each of the plurality of brackets protrudes radially outwardly from the elongated bar to a radial distance that is less than an outermost diameter of the cylindrical core.

18. The exercise roller according to claim 1, further comprising one or more accessory bolts protruding axially outward from the elongated bar.

19. A method of manufacturing an exercise roller, the method comprising:

forming grip handles at opposing axial ends of an elongated bar;

arranging a cylindrical core on the elongated bar between the grip handles;

overmolding or wrapping a cover around the cylindrical core, wherein the cover has a pattern that repeats around the cylindrical core; and removably attaching a plurality of brackets to the elongated bar.

* * * * *